United States Patent [19]

Seecamp

[11] 4,201,113

[45] May 6, 1980

[54] TELESCOPING RETURN-SPRING ASSEMBLY FOR AUTOMATIC HANDGUNS

[76] Inventor: Lueder Seecamp, 62 Shelter Cove Rd., Milford, Conn. 06460

[21] Appl. No.: 937,765

[22] Filed: Aug. 29, 1978

[51] Int. Cl.[2] ..... F41D 11/12

[52] U.S. Cl. ..... 89/199; 89/163

[58] Field of Search ..... 89/163, 178, 196, 199

[56] References Cited

U.S. PATENT DOCUMENTS

| | | | |
|---|---|---|---|
| 580,924 | 4/1897 | Browning | 89/163 |
| 3,435,728 | 4/1969 | Pachmayr et al. | 89/199 |
| 3,731,590 | 5/1973 | Zimmerman | 89/163 |
| 4,040,332 | 8/1977 | Border et al. | 89/37 F |

OTHER PUBLICATIONS

Semi-Automatic Sporting Rifle SIG-AMT Owners Manuel.

SIG assault rifle SG 510 Series.

George M. Chinn, The Machine Gun, 1955, vol. IV, p. 487.

Nicholas P. Chironis, Spring Design and Application, 1961, pp. 45 and 170.

"Another Pocket Size .45 Auto," Popular Guns, Jan. 1978, pp. 76–77.

*Primary Examiner*—Stephen C. Bentley

*Attorney, Agent, or Firm*—St. Onge, Steward, Johnston, Reens & Noe

[57] ABSTRACT

A return-spring assembly for slide-type automatic pistols in which an inner spring and an outer spring are coupled together so that they work in tandem.

17 Claims, 4 Drawing Figures

TELESCOPING RETURN-SPRING ASSEMBLY FOR AUTOMATIC HANDGUNS

BACKGROUND OF THE INVENTION

The present invention, which is the subject matter of U.S. Disclosure Document No. 058305 filed Feb. 28, 1977, relates to return springs for autoloading firearms, and it relates more particularly to multi-spring assemblies for slide-type automatic pistols in which a breech-member compresses a coil spring as it moves out of breech-closing or battery position and is returned to battery by the spring.

In spring-reliant apparatus of various kinds, in which there is a limited amount of space for housing a coil spring, it is frequently difficult to design a spring or spring system which is capable of releasing its stored energy at the desired rate throughout the required distance of travel. This problem is encountered in the design, or redesign, of small automatic handguns where it is desired to make the gun as small as possible, yet capable of firing ammunition of the suitable caliber for self-defense purposes. Typical of such weapons are the well-known Colt .45 and 1911 Government automatic, both of which have been used by the United States armed services for many years. In this type of pistol, the breech-bolt forms part of a slide, that reciprocates on the frame and totally surrounds the barrel when in battery position, the slide being driven rearward by the recoil of the gun when fired and returned to battery by a recoil spring. Since the slide meets with some resistance during its forward movement into battery, including for example, overcoming inertia and friction between it and the frame, as well as in stripping a fresh cartridge from the magazine and in this case in locking the slide to the barrel, the return spring must store considerable energy in order to ensure reliable action.

The difficulty with most automatic pistols of this type is that for personal defense purposes the barrel and slide are too long, making them too bulky to carry concealed on the person. To my knowledge no way has been found heretofore to reduce the length of the barrel and slide without adversely affecting the performance and/or safety of the gun, due to the space limitations for the recoil spring which such shortening imposes. In fact, where the length of the barrel and slide are reduced below that of Colt's "Combat Commander", it has been found by discriminating gun experts to be impossible to design a return spring that functions properly.

Although a number of different techniques have been used in attempts to overcome the spring problem created by the necessity of shortening the slide as well as the barrel in such guns, none of the methods employed heretofore offers anything approaching a satisfactory solution. Prior efforts using telescoping recoil springs to shorten the slide and barrel of the Colt .45, for example, have resulted in very little spring pressure when the slide is forward in battery, so that any gain in the reduced size of the gun has been dearly paid for in reliability. In many instances, the free length of the recoil spring barely exceeds its compressed length at battery, with the resultant spring load being so poor that the slide is not held firmly in breech-closing position during normal handling of the pistol, thereby severely reducing the quality and performance of the spring action.

In addition to the single recoil-spring typical of the slide-type automatics, are multi-spring arrangements shown for example in U.S. Patents to Browning, No. 580,924, Zimmerman, No. 3,731,590 and Border et al, No. 4,040,332. Browning U.S. Pat. No. 580,924 discloses the use of a buffer spring in conjunction with the typical recoil spring employed in one of the early Browning automatic pistols which preceeded production of the Government Model 1911 designed by John M. Browning. In the Zimmerman patent a take-up spring is used inside a conventional recoil spring for an autoloading pistol. However, in this system the take-up spring is arranged so that it works in opposition to the recoil spring. In the Border et al U.S. Pat. No. 4,040,332, a variable spring rate is produced by employing two coil springs of different rates end-to-end with a floating piston between them.

In addition, the Swiss semi-automatic sporting rifle known as the SIG-AMT manufactured by Swiss Industrial Company of Neuhausen Rine Falls, Switzerland, employs a multi-spring recoil system which is similar to that of my invention, but differs in important respects, with the result that it is incapable of being employed in situations where space is severely limited. Thus, in the SIG rifle the recoil spring assembly consists of telescoping springs which are connected in tandem by an elongate coupling sleeve. However, the SIG spring assembly is not suited for use in slide-type automatic pistols due to the large coil diameter of the outer spring necessitated by the complexity of the system and its many telescoping parts. Furthermore, the SIG arrangement does not allow compression of the spring assembly beyond the space taken up by the longest of its component parts, including guide and support units, so that the arrangement does not provide a solution to problems arising from severely restricted space.

Attention is also directed to the buffer spring arrangements shown in a United States Government book published in 1955 entitled *The Machine Gun, Design Analysis of Automatic Firing Mechanisms and Related Components* compiled by George M. Chinn (Vol. IV, parts X and XI). Example A of FIG. 15-5 on page 487 of this publication shows a recoil spring assembly comprising a buffer spring and barrel return spring acting in series. Here again space for the springs is not a controlling factor, and the coupling sleeve connecting the two springs merely serves to limit the amount of deflection of the barrel return spring and to properly position the buffer spring.

Other instances in which multiple-coil springs are used for absorbing the recoil of a firearm and for returning the action to battery position are the Detonics automatic pistols made by Detonics .45 Associates of Seattle, Washington, and the custom Colt .45 Associates of Seattle, Washington, and the custom Colt .45 shortening jobs done by Pachmayr Gun Works of Los Angeles, California, and by Behlert Custom Guns, Inc. of Union, New Jersey. In each of these guns, a pair of recoil springs are used, one within the other (and with right and left hand helix to prevent entanglement with each other). Each spring engages both the slide and frame, so that they act in parallel. This spring configuration can be found in FIG. 28, page 45, of a book entitled *Spring Design and Application,* which is edited by Nicholas P. Chironis and was published in 1961 by the McGraw-Hill Book Company, Inc. of New York.

SUMMARY OF THE INVENTION

A basic object of the present invention is to provide an improved recoil or return-spring assembly for automatic handguns in which the spring assembly occupies a small amount of space, while producing more dynamic and thoroughly reliable spring action than has been obtained heretofore by recoil-spring systems employed in shortened automatic pistols. Another object of the invention is to provide a return-spring assembly which will exhibit a smoother and stronger action at all points along the path through which it works than a single coil-spring is capable of providing where the space available is severely limited.

The invention resides generally in providing a return-spring assembly for a slide-type automatic pistol having a pair of telescopically arranged outer and inner coil springs, between which is provided a elongate sleeve-like device for coupling the two springs so that they act in tandem. The outer spring is disposed externally of the coupling device and is restrained at one end by an external spring-retainer on the coupling device and at the other end either by the breech-block slide or the frame of the pistol. One end of the inner spring fits inside the coupling device and is compressed against an internal spring retainer provided therein, while the opposite end of the inner spring is restrained by the other one of the frame and slide of the pistol. Preferably, the outer spring is compressed against the slide and the inner against the frame. In one form of the invention the spring assembly is arranged to be disposed co-axially of an opening in the slide, so that upon retraction of the slide against the spring, the coupling device moves lengthwise through the opening and therefore does not reduce the distance through which the slide can travel. In this way the coupling device can be made as long as necessary while still taking up very little of the space available for the outer spring to work. Moreover, since the inner spring is disposed inside the enlongate coupling device, it too extends through the opening, providing an almost unlimited amount of space within which to work.

A specific embodiment of the invention resides in a return-spring assembly which is a self-contained unit, having in addition to the hereinabove-mentioned telescoping springs and coupling device, a guide-rod extending completely through the two springs and coupler. One end of the guide-rod is fixed to a positioning plate against which the inner spring presses, while the other end extends beyond the coupling device and is provided with a retainer, which may consist simply of an enlargement on the end of the guide-rod which prevents the coupling device from moving beyond the end of the guide-rod. Such self-contained spring assembly also includes a bushing surrounding the outer end of the coupling device. The bushing seats in a suitable manner against the breech-bolt slide co-axially with an opening therein. One end of the outer spring of the assembly rests against a suitable stop or shoulder within the bushing, which is held in place on the coupler when the assembly is not installed in the pistol by an enlargement at the outer end of the coupler. The positioning plate on the guide-rod is suitably formed to seat in the usual manner against a portion of the pistol frame.

DETAILED DESCRIPTION OF PREFERRED EMBODIMENTS

The invention is illustrated in the accompanying drawings, in which

Figure 1:
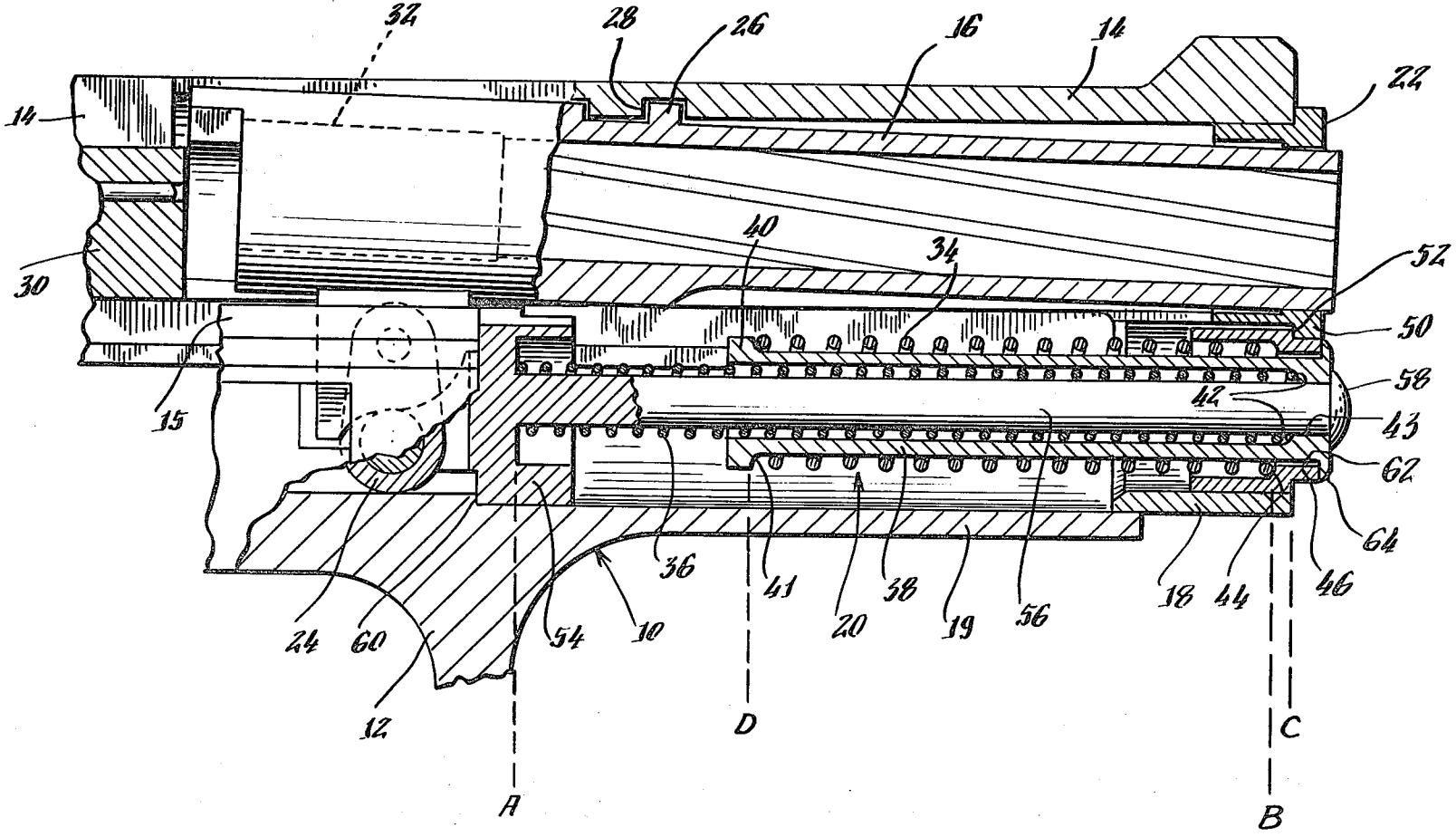
FIG. 1 is a longitudinal sectional view of a portion of a slide-type automatic pistol, similar to the Colt .45 or Government Model 1911, showing the barrel and part of the slide, and incorporating one form of return-spring assembly of the present invention.

For purposes of illustration, the return-spring assembly of the present invention is disclosed in connection with a Colt's "Combat Commander" .45 caliber pistol, in which the barrel and slide have been shortened by 0.65 inch. The basic .45 caliber Colt automatic pistols are locked-breechbolt, recoil-operated guns, in which the barrel and slide are locked together by tilting the barrel so that locking ribs on the upper side of the barrel are engaged in locking surfaces in the top inside surface of the slide. The construction and operation of these pistols is adequately described in a book by E.J. Hoffschmidt entitled "Know Your .45 Auto Pistol-Models 1911 & A1" published in 1974 by Blacksmith Inc. of Stamford, Connecticut. These guns represent one form of what is referred to generally herein as "slide-type automatic pistols", this term being intended in the claims appended hereto to encompass any pistol having a barrel and breech-bolt slide that are relatively movable into and out of breech-closing, or battery, position with respect to each other. In battery the slide of the Colt .45 pistol is always positively locked with the barrel, but in other types of slide-type pistols, especially those of smaller caliber, no positive locking system is used, only the inertia of the parts being relied upon to maintain the slide in breech-closing position.

In the drawings, the frame 10 of the pistol has a trigger-guard (partially shown at 12) that is integral with a grip-portion (not shown) which extends downward from the frame 10 in back of the trigger-guard. A breech-bolt slide 14 slides on outwardly extending ribs 15 on opposite sides of the upper portion of the frame. Slide 14 extends forward, completely enclosing the upper portion of the barrel 16, and is provided at its front end with a tubularly shaped member 18 (usually referred to as the spring tunnel), which extends downward from the slide 14 and is integral therewith. Frame 10 is also provided with a semi-cylindrical extension 19 forward of the trigger-guard 12 for enclosing the recoil spring. When the pistol is fired, slide 14 and spring tunnel 18 move rearwardly of the semi-cylindrical extension 19 of frame 10 to the position shown in FIG. 2.

Barrel 16 is supported at its muzzel end within a bushing 22 in the slide 14 and is pivotally connected near its breech end to the frame 10 by a link 24. When in battery, barrel 16 is raised upward on link 24 to engage a locking rib 26 with a mating groove 28 in slide 14. In this position, the breech-bolt portion 30 of slide 14 is locked in breech-closing relation with the cartridge-chamber 32 in barrel 16. On discharge of a cartridge, the barrel and slide initially move together a short distance rearward causing the barrel to tilt down at its breech end, releasing the slide 14; whereupon the slide continues to recoil to its fully retracted position shown in FIG. 2.

Since the amount of slide travel required to allow empty cases to be ejected and fresh rounds to be chambered has a well-defined lower limit, adequate spring space at full-recoil position is commonly provided by increasing the amount of spring space at battery until the required slide travel is obtained. In other words, until now the length of the slide has had to be adjusted in order to accommodate the recoil spring needed. Consequently, in the specific case at hand, since it has not been possible to make a single recoil spring which is adequate when the space available for such spring at full recoil is appreciably reduced below that available in Colt's "Combat Commander", the recoil or return spring indicated generally at 20 of the present invention is designed to provide healthy spring action despite the smaller amount of space available at full recoil which reduction in the length of the slide entails. The return-spring 20 is a multi-spring assembly, consisting in this instance of two telescoping springs 34 and 36, which are coupled together in tandem, so to speak, instead of in parallel. In other words, the pressure exerted by each spring is transmitted through the other as if they were disposed end-to-end, rather than each of the springs acting directly on both the slide and on the frame.

Springs 34 and 36 are connected by a coupling sleeve 38, which has an external spring-retainer at its rear end comprising an outwardly extending annular flange 40 that forms a forwardly facing shoulder 41, and an internal spring-retainer comprising a rearwardly facing annular shoulder 42 formed by an internal lip 43 at the front end of sleeve 38. The outer spring 34 encircles coupling sleeve 38 and is compressed between the outer shoulder 41 and a rearwardly facing internal shoulder 44 on a bushing 46, which rests against the usual depending lip 50 on the barrel bushing 22. Bushing 46, which corresponds to the spring plug employed in the conventional Colt .45, has a forwardly facing external shoulder 52 that fits against the lip 50. The inner spring 36 extends into the bore of coupling sleeve 38 and is compressed between the internal shoulder 42 thereof and an enlarged cup-shaped positioning plate 54 fixed to the rear of a guide-rod 56 supporting the inner spring 36.

In this instance, guide-rod 56 is long enough to extend completely through the spring assembly and projects a short distance beyond the front end of coupling sleeve 38 when the pistol is in battery. The outer end 58 of the guide-rod is desirably peened over, or otherwise enlarged for the purpose of retaining coupling sleeve 38 when the spring-assembly is removed from the gun. The positioning plate 54 of guide-rod 56 seats in the usual manner against a shoulder 60 formed in frame 10 at the juncture of the guide ribs 15 on the upper portion of the frame with its semi-cylindrical extension 19.

Figure 2:
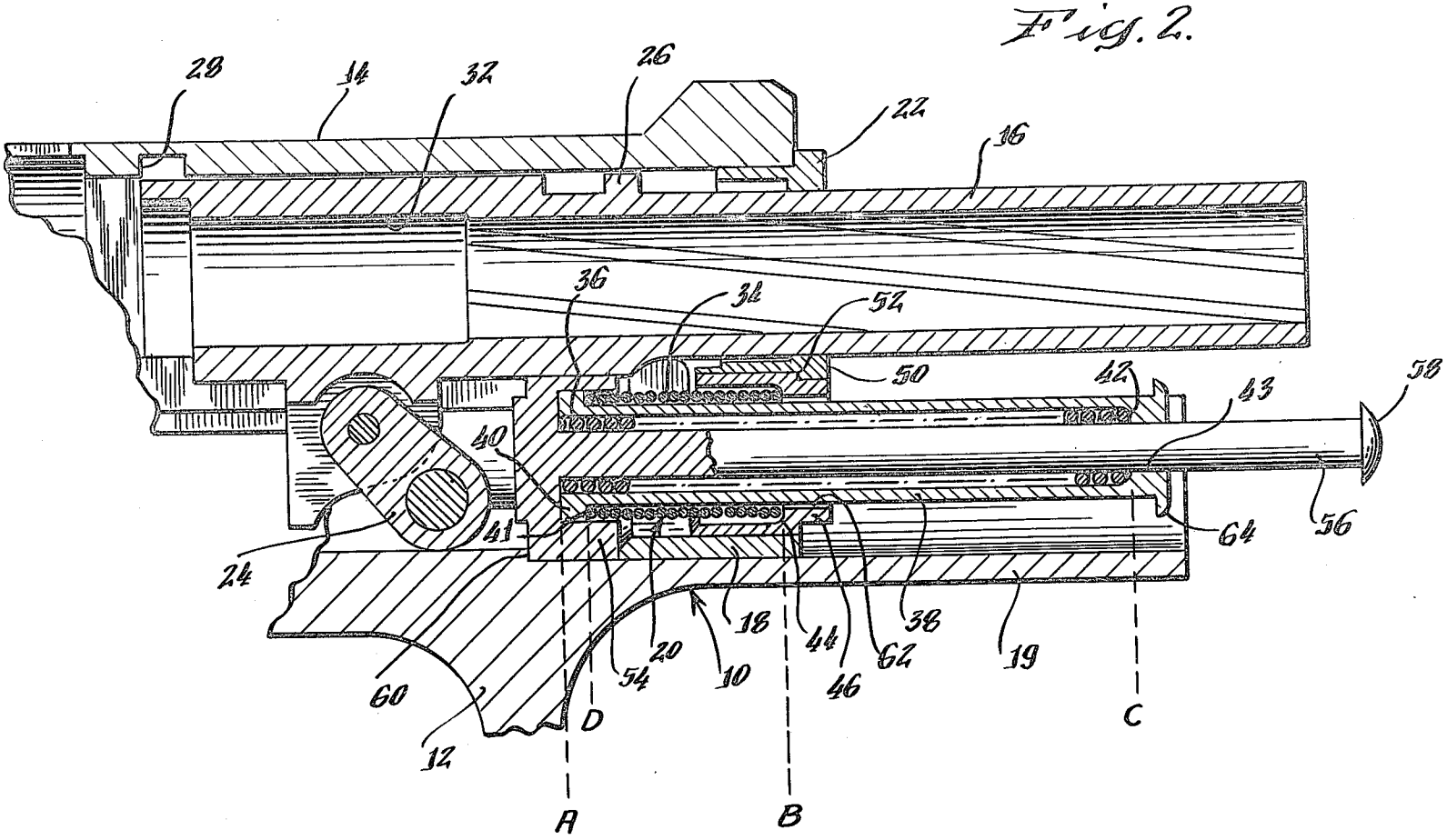
FIG. 2 is a view similar to FIG. 1, but showing the slide in fully retracted position.
Figure 3:
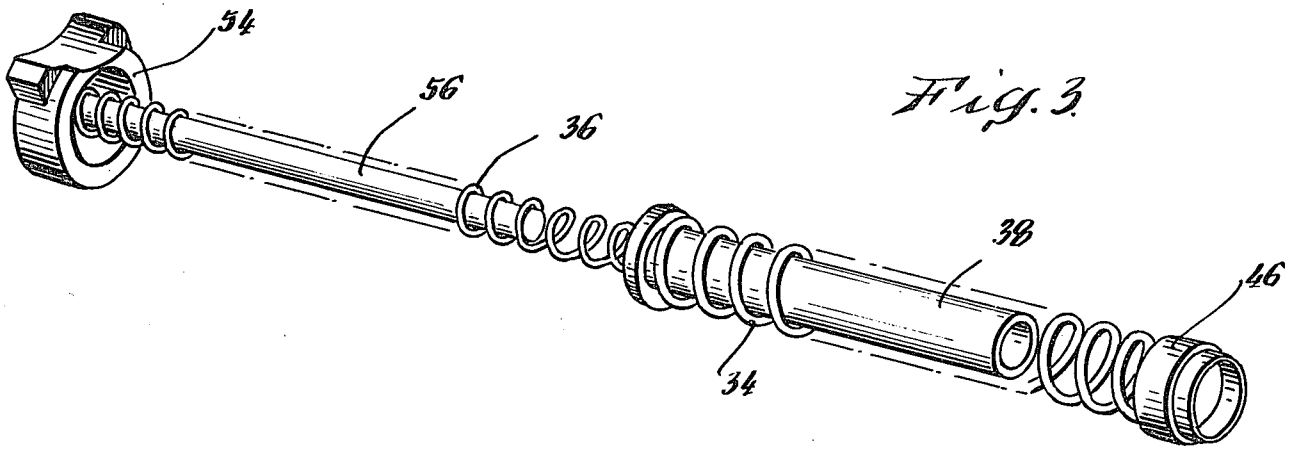
FIG. 3 is a perspective view of the return-spring assembly of FIGS. 1 and 2 fully extended.

When the slide 14 recoils on firing the pistol, or is retracted manually, spring assembly 20 is compressed as the slide moves to the fully retracted or recoil position shown in FIG. 2, in which the rear edge of spring tunnel 18 engages the front edge of the skirt portion of positioning plate 54, which acts as a buffer for receiving the impact of the rearward travel of the slide.

In the full-recoil position of slide 14, both springs 34 and 36 are for all practical purposes completely compressed or near their solid height, in which condition they store much of the energy of recoil for returning the slide to battery. The inner spring 36 presses against the bottom of the cup of positioning plate 54, which in turn is in rigid abutment with the shoulder 60 on the frame 10. The other end of spring 36 presses against the internal spring-retaining shoulder 42 of sleeve 38, thereby transmitting its load to, and compressing, the outer spring 34 through the external spring-retaining flange 40 on the coupling sleeve. The outer spring thus applies the joint load of both springs acting in tandem. In passing it should be noted that the barrel bushing 22, which locks the spring bushing 46 to slide 14 by means of the retaining lip 50, is fastened in the usual manner to the slide 14 by means of a bayonet joint (not shown).

Depending on the relative stiffness of the two springs 34 and 36, retraction of slide 14 compresses both springs simultaneously, one at a time or a combination of both, thereby providing great flexibility of choice in selection of variable spring rates and loads at various points along the path of travel of the slide 14. As the outer spring 34 is compressed, the coupling sleeve 38 is permitted to telescope forwardly through the opening 62 in the bushing 46 at the front of the spring tunnel 18 of slide 14. The inner spring 36, on the other hand, is compressed by the pressure of outer spring 34 on coupling sleeve 38, moving the sleeve from the position shown in FIG. 1 until it bottoms in the cup-portion of positioning plate 54, as shown in FIG. 2. Furthermore, since the length of the coupling sleeve 38 can be varied, the spring space for the inner spring 36 at full recoil can be varied over a wide range in order to accommodate springs that produce the desired load and rate. The term "spring space" is used herein to define the distance measured longitudinally of a spring which is occupied by such spring at any point to which it is deflected.

It will be noted that the spring space available both at battery and in full recoil in conventional pistols of this type is the distance between the positioning plate, corresponding to the plane A (FIG. 1) at the bottom of the cup of positioning plate 54, and the retaining shoulder on the slide, corresponding to the plane B at the shoulder 44 of bushing 46. In the present system, however, as the slide 14 retracts from its battery position to its full-recoil position, spring compression is divided between the inner spring 36 and the outer spring 34 until one or the other is fully compressed, thereby paralleling the action of a much longer spring than the available space would otherwise permit. Thus, due to the fact that the springs work in tandem, the spring space available for the spring assembly 20 as a whole is the space for inner spring 36 between plane A and a plane C at the inside shoulder 42 on coupling sleeve 38 plus the space for outer spring 34 between a plane D at the external shoulder 41 of sleeve 38 and the plane B. While the spring space or maximum solid height of the outer spring 34 is reduced by the distance between plane A and plane D in full-recoil as compared with that available for springs in a conventional system, the lost full-recoil spring space for the outer spring 34 is offset and greatly augmented by the plane A to plane C spring space available to the inner spring 36. For example, in the illustration which follows, even though the outer spring 34 at full recoil has 7% less spring space as compared to conventional systems, the spring assembly 20 in accordance with my invention provides 2.75 times the load at battery that a single spring similar to the outer spring 34 could supply if the space lost at full-recoil were utilized by using a longer spring.

The foregoing results are best illustrated in the following specific example of a return-spring assembly as shown in FIGS. 1 and 2 which was installed in a Colt's "Combat Commander" after the barrel and slide had been shortened by 0.65 inch:

| | |
|---|---|
| Spring space AC for inner spring 36 at battery position (FIG. 1) | 2.56" |
| Spring space DB for outer spring 34 at | |

-continued

| | |
|---|---|
| battery position | 1.68" |
| Total effective spring space at battery | 4.24" |
| Corresponding spring space AC for inner spring 36 at full-recoil position (FIG. 2) | 1.81" |
| Corresponding spring space DB at outer spring 34 at full-recoil position | 0.67" |
| Total effective spring space at full recoil position | 2.48" |

In comparison, if return springs of the prior art were employed in this particular situation, the spring space available at the battery position (FIG. 1) would be 2.52 inches, while at the full-recoil position (FIG. 2), the space available would be only 0.72 inches. As any competent spring manufacturer will confirm, it is not possible within such available space to make a reliable coil spring which will exert a load at battery sufficient to ensure that the breech is locked where such load should be on the order of 5 to 7 pounds, as in the case of Colt .45 automatic pistols.

In the specific example given hereinabove, for a shortened Colt's "Combat Commander" the overall length of the coupling sleeve 38 was 1.930 inches, the outside diameter was 0.337 inch, the inside diameter 0.280 inches and the width of the outer flange or lip 40 was 0.050 inches. The outside dimension of flange 40 is not critical, other than to ensure that it fits within the skirt of the positioning plate 54. In order to provide as much space as possible for the inner spring 36, the internal shoulder 42 should be located as near the outer end of the sleeve as possible, with the inner edge of the annular lip 43 forming a sliding fit on guide-rod 56. In this instance shoulder 42 is located 0.12 inches from the outer end of sleeve 38. Since the outer surface of coupling sleeve 38 is in sliding engagement with the opening 62 in bushing 46, it is guided both internally and externally, thereby maintaining it in alignment with springs 34 and 36 for smoother action.

For purposes of keeping the spring-assembly 20 as a self-contained unit when it is removed from the pistol, the outer end of coupling sleeve 38 is enlarged forming a stop shoulder 64 outward of bushing 46. When the slide 14 is in battery, shoulder 64 is disposed immediately adjacent the outer end of bushing 46. However, no pressure should be exerted between shoulder 64 and bushing 46 as this would interfere with the action of spring 34 and 36. When it is desired to remove the return-spring assembly from the pistol, the barrel 16 and slide 14 are disassembled from frame 10 in the usual manner, and the positioning plate 54 of the spring-assembly dropped downward until it clears the barrel link 24. The spring-assembly 20 can then be slid rearwardly out of the spring tunnel 18 with its springs 34 and 36, coupling sleeve 38 and bushing 46 remaining assembled on guide-rod 56, due to the retaining head 58 on the end of guide-rod 56 and to the shoulder 64 on the outer end of sleeve 38. It will be noted, however, that the retaining head 58 and shoulder 64 perform no function once the spring-assembly 20 is installed, their only purpose being to keep it as a self-contained unit when it is removed from the gun.

It is essential that the pressure exerted by springs 34 and 36 on slide 14 when in the battery position be sufficient to ensure locking with the barrel 16. Moreover, for appearance purposes, the outer end of spring-coupling sleeve 38 should be almost even with the outer end of bushing 46. Due to the fact that sleeve 38 floats freely between the springs 34 and 36, it is necessary to select springs in which each exerts about the same load at the point in its deflection where its length equals the available spring space at battery, namely the space shown in FIG. 1 between planes A and C for the inner spring 36 and the space between planes D and B for the outer spring 34. Springs made of music wire having the following specifications were employed in the particular examples given hereinabove:

| | Outer spring 34 | Inner spring 36 |
|---|---|---|
| Wire diameter in inches | 0.043 | 0.033 |
| Outer coil diameter in inches | 0.435 | 0.258 |
| Mean coil diameter in inches | 0.392 | 0.225 |
| Number of active coils | 13 | 47 |
| Number of end coils | 1 | 2 |
| Types of ends | Open at muzzle end and closed at other end | Closed and ground |
| Free length in inches | 2.730 | 4.850 |
| Solid height in inches | 0.645 | 1.617 |
| Height at battery in inches | 1.680 | 2.560 |
| Deflection at battery in inches | 1.050 | 2.290 |
| Spring rate in pounds per inch of deflection | 6.240 | 2.950 |
| Load at battery in pounds | 6.550 | 6.760 |
| Modulus in torsion (psi) | $11.5 \times 10^6$ | $11.5 \times 10^6$ |

As has been mentioned herebefore, the spring system of the present invention allows much greater flexibility in choice of spring action than conventional methods can provide. Thus, the spring space for the inner spring 36 at full recoil can be selected to obtain different overall spring rates and working loads. Furthermore, since the length of the inner spring at full compression (solid) is not severely restricted, it can have a wide range of free-length heights. The balance between the inner and outer springs can also be calculated so that both compress fully at about the same time or, in order to obtain a dual spring rate, one spring can compress fully before the other. In addition, in some automatic pistols, it may be desirable to provide a recoil buffer, in which case the inner spring could consist of two telescoping springs of different wire sizes and lengths, so that one does not compress until the slide is about to reach full recoil.

Figure 4:
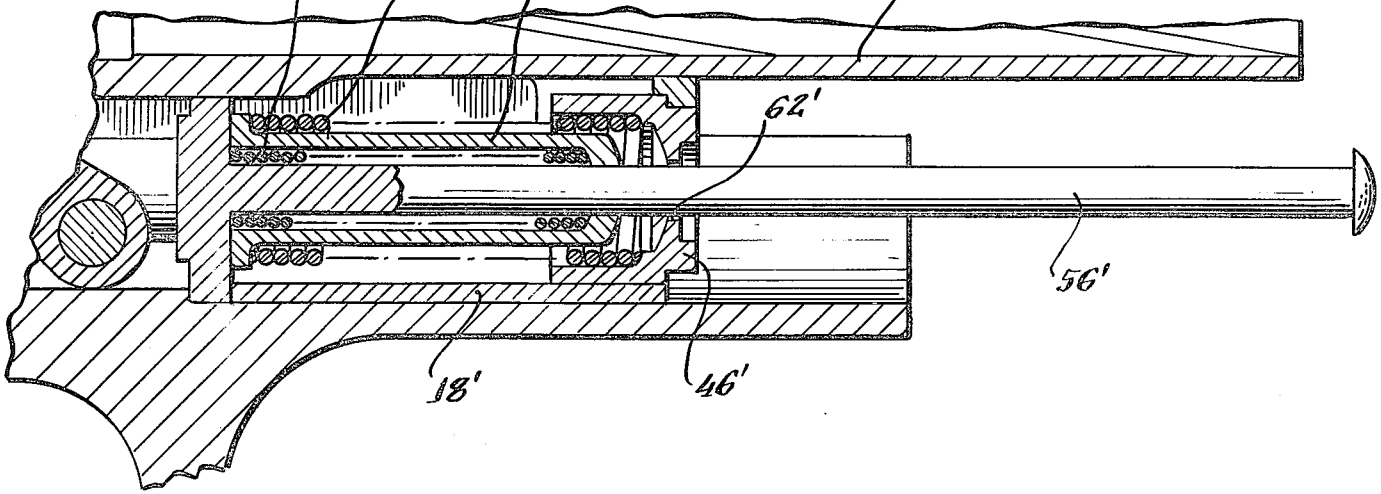
FIG. 4 is a longitudinal sectional view of another embodiment of the invention.

Referring now to FIG. 4, it will be noted that the invention can be used to advantage in some situations where it is not necessary for the coupling sleeve and inner spring to project through the muzzle end of the slide. For example, the return-spring action for a Colt's "Combat Commander", which has not been shortened, can be improved by installing a spring assembly 20' consisting of an outer spring 34', an inner spring 36', and a coupling sleeve 38'. The original barrel 16' and slide with depending spring tunnel 18' were both used without alteration, but a longer guide-rod 56' was provided in order to support the inner spring 36', and a small opening 62' was provided in the end of spring-plug 46' in order to allow the longer guide-rod 56' to pass through it.

What is claimed is:

1. A return-spring assembly for a slide-type automatic pistol having a frame-member and a breech-closing slide-member reciprocably mounted thereon for movement into and out of battery, said return-spring assembly being mounted between said members for returning said slide-member to battery and comprising outer and inner elongate coil springs arranged coaxially in telescoping relation and an elongate sleeve-like spring coupling device disposed co-axially of said springs and having an external spring-retainer adjacent one end and an internal spring-retainer adjacent its opposite end, at least a portion of said outer spring being disposed externally of said spring-coupling device and restrained at one end by said external spring-retainer from axial movement in one direction relative to said spring-coupling device, the other end of said outer spring being restrained by one of said members such that said outer spring is under compression when said slide-member is in battery, at least a portion of said inner spring being disposed within said spring-coupling device and restrained at one end by said internal spring-retainer from axial movement in the opposite direction relative to said spring-coupling device, the other end of said inner spring being restrained by the other of said members such that said inner spring is also under compression when said slide-member is in battery.

2. A return-spring assembly as defined in claim 1, wherein said one member is said slide-member which is provided with an opening larger than the adjacent section of said spring-coupling device in order to allow said spring-coupling device to move axially through said opening, said opening being disposed co-axially of said springs, such that said spring-coupling device passes through said opening upon movement of said slide-member out of battery against the pressure of said springs.

3. A return-spring assembly as defined in claim 1, which further includes a guide-rod disposed co-axially of and within said inner spring, said guide-rod being adapted and arranged for mounting on said frame-member in fixed relation thereto.

4. A return-spring assembly as defined in claim 2, which further includes a guide-rod disposed co-axially of and within said inner spring, said guide-rod being adapted and arranged for mounting on said frame-member in fixed relation thereto.

5. A return-spring assembly as defined in claim 4, wherein said guide-rod extends through said opening in said slide-member, said internal spring-retainer on said spring-coupling device comprising a radially inwardly extending annular lip against which said inner spring is urged, the inner edge of said annular lip being in sliding contact with said guide-rod, said spring-coupling device being in sliding contact within said opening in said slide-member, whereby said spring-coupling device is guided internally on said guide-rod and externally within said opening in said slide-member.

6. A return-spring assembly as defined in claim 5, wherein said external spring-retainer on said spring-coupling device comprises a radially outwardly extending annular flange against which said outer spring is urged.

7. A return-spring assembly as defined in claim 5, wherein all of the coils of said outer spring encircle said spring-coupling device when said members are in battery.

8. A return-spring assembly as defined in any of claims 1 through 4, wherein said spring-coupling device is a substantially cylindrical sleeve and said external spring-retainer on said spring-coupling device comprises a radially outwardly extending annular flange against which said outer spring is urged in said one direction, said internal spring-retainer comprising a radially inwardly extending annular lip against which said inner spring is urged in said opposite direction.

9. A return-spring assembly as defined in any of claims 4 through 7, which is a self-contained unit, said guide-rod being provided with a positioning plate against which said other end of said inner spring is urged, said guide-rod being longer than said spring-coupling device so that it projects beyond the end thereof in said opposite direction and is provided adjacent said end with means for limiting movement of said spring-coupling device on said guide-rod in said opposite direction in order to confine said inner spring within the length of said guide-rod when said return-spring assembly is removed from the pistol, said spring assembly further including a bushing adapted to be positioned on said slide-member co-axially of said opening and to be fixed against movement relative to said slide-member in said opposite direction, said bushing having means for restraining said other end of said outer spring against movement relative to said slide-member in said opposite direction, said spring-coupling device having means adjacent its said opposite end for limiting the movement of said bushing relative to said spring-coupling device in order to confine said outer spring within the length of said spring-coupling device when said spring assembly is removed from the pistol.

10. A return-spring assembly for a slide-type automatic pistol having a frame-member and a breech-bolt slide mounted thereon for reciprocating movement into and out of battery position, wherein said breech-bolt slide is provided with a portion having an opening therein defining a central axis, said return-spring assembly comprising an elongate open-ended spring-coupling sleeve with an external spring-retainer adjacent one end and an internal spring-retainer adjacent the opposite end, an outer coil-spring having a plurality of coils encircling a section of said spring-coupling sleeve for compression between said external spring-retainer and said breech-bolt slide, said outer coil-spring and said spring-coupling sleeve being disposed of said opening in said breech-bolt slide and an inner coil-spring adapted to fit within said spring-coupling sleeve for compression between said internal spring-retainer and said frame-member.

11. A return-spring assembly as defined in claim 10, which further includes a guide-rod adapted to be fixed at one end by said frame-member against movement relative thereto and to fit through the coils of said inner spring and co-axially through said opening in said breech-bolt slide.

12. A return-spring assembly as defined in claim 11, wherein said opening in said breech-bolt slide is larger than the adjacent section of said spring-coupling sleeve and smaller than the cross-section of said outer coil-spring, such that said outer spring is retained by said portion of said slide while said sleeve is movable through said opening on compression of said outer spring.

13. A return-spring assembly as defined in claim 12, wherein said internal spring-retainer on said spring-coupling sleeve comprises a radially inwardly extending annular lip against which said inner spring is urged, the inner edge of said annular lip being in sliding contact with said guide-rod.

14. A return-spring assembly as defined in claim 13, wherein said external spring-retainer on said spring-coupling sleeve comprises a radially outwardly extending annular flange against which said outer spring is urged.

15. A return-spring assembly as defined in claim 14, wherein the length and stiffness of said springs and the length of said spring-coupling sleeve are such that said sleeve extends into said opening in said breech-bolt slide when it is in battery, said spring-coupling sleeve being guided internally by engagement of said lip with said guide-rod and externally within said opening in said breech-bolt slide.

16. A return-spring assembly as defined in any of claims 11 through 14, wherein the length and stiffness of said springs and the length of said spring-coupling sleeve are such that said sleeve extends into said opening in said breech-bolt slide when it is in battery, said spring-coupling sleeve being guided internally on said guide-rod and externally within said opening.

17. A return-spring assembly as defined in any of claims 11 through 14, which is a self-contained unit, and wherein said guide-rod is provided with a base against which one end of said inner spring is urged, said base being adapted and arranged to be held in the frame of the firearm against movement relative thereto in the direction in which it is urged by said inner spring, said guide-rod being longer than said spring-coupling sleeve so that it projects beyond the end thereof in the opposite direction and is provided adjacent said end with means for limiting movement of said sleeve on said guide-rod in said opposite direction in order to retain said sleeve and said inner spring on said guide-rod when said return-spring assembly is removed from the pistol, said return-spring assembly further including a bushing through which said spring-coupling sleeve extends, said bushing being mounted on said breech-bolt slide co-axially of said opening and fixed against movement relative thereto in said opposite direction, said bushing having means for restraining the adjacent end of said outer spring against movement relative to said breech-bolt slide in said opposite direction, said spring-coupling sleeve having means adjacent its said opposite end for limiting the movement of said bushing relative thereto in said opposite direction in order to retain said bushing and said outer spring on said sleeve when said spring assembly is removed from the pistol.

* * * * *